US006145906A

United States Patent [19]

Wright et al.

[11] Patent Number: 6,145,906

[45] Date of Patent: Nov. 14, 2000

[54] SERVING TRAY

[76] Inventors: Richard L. Wright, 1138 Euclid St., Unit 2, Santa Monica, Calif. 90403; Richard L. Wright, Sr., 3480 Alamo St., Simi Valley, Calif. 93063

[21] Appl. No.: 09/174,802

[22] Filed: Oct. 13, 1998

Related U.S. Application Data

[60] Provisional application No. 60/064,123, Nov. 3, 1997.

[51] Int. Cl.[7] ..... A47G 23/06

[52] U.S. Cl. ..... 294/172; 206/557; 220/574; 294/144

[58] Field of Search ..... 294/3.5, 25, 137, 294/144, 146, 159, 172; 206/557, 563, 564; 211/126; 220/23.83, 556, 574, 575, 608, 752, 755, 756, 914; 224/217, 218; D7/54.3, 550.1, 552.1

[56] References Cited

U.S. PATENT DOCUMENTS

| | | | |
|---|---|---|---|
| 2,213,837 | 9/1940 | Gill | 220/575 |
| 3,078,005 | 2/1963 | Lewerth | 220/575 |
| 3,504,832 | 4/1970 | Corvetti | 294/172 X |
| 4,746,057 | 5/1988 | Wagner | 294/144 X |
| 5,076,438 | 12/1991 | Aronson | 294/172 X |
| 5,207,743 | 5/1993 | Costarella et al. | 220/575 X |
| 5,429,231 | 7/1995 | McSpadden | 220/556 X |
| 5,593,062 | 1/1997 | Martin | 220/556 X |
| 5,732,847 | 3/1998 | Caldi | 220/575 |
| 5,797,495 | 8/1998 | Lerrick | 294/172 X |
| 5,803,305 | 9/1998 | Perlis et al. | 220/574 |

FOREIGN PATENT DOCUMENTS

| | | | |
|---|---|---|---|
| 2572915 | 5/1986 | France | 294/172 |
| 9012528 | 11/1990 | WIPO | 294/172 |

*Primary Examiner*—Johnny D. Cherry
*Attorney, Agent, or Firm*—Roger A. Marrs

[57] ABSTRACT

A serving tray handling device having a glass or dish supporting surface and an undersurface provided with a finger-gripping projection or core which is surrounded by a recess or groove so that the user's fingers may be inserted into the recess or groove to grip the exterior wall surface of the projection or core. The core may receive a fitted cap of soft material. The core exterior wall surface is tapered inwardly for easy-grip while an opposing recess defining wall may also be inwardly sloped permitting accommodating of finger insertion into the recess or groove.

3 Claims, 2 Drawing Sheets

FIG. 1
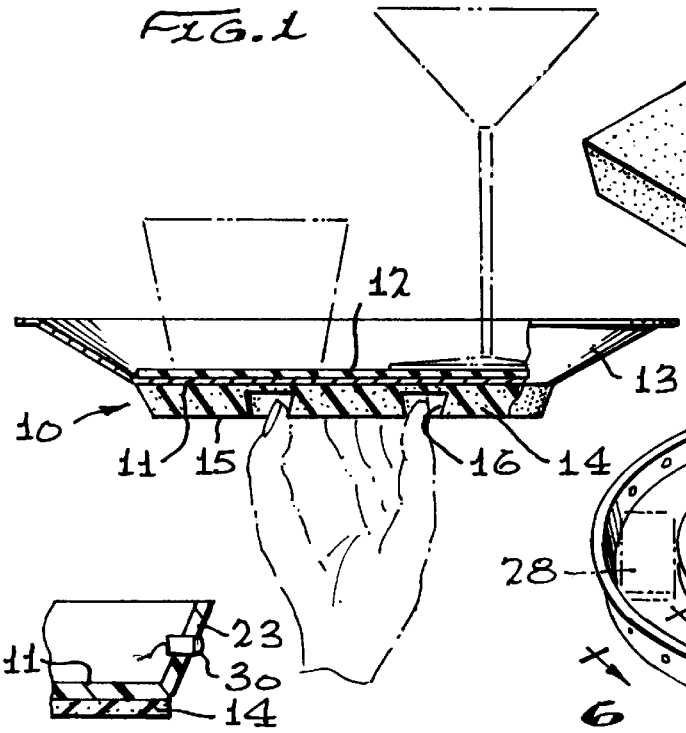
FIG. 7
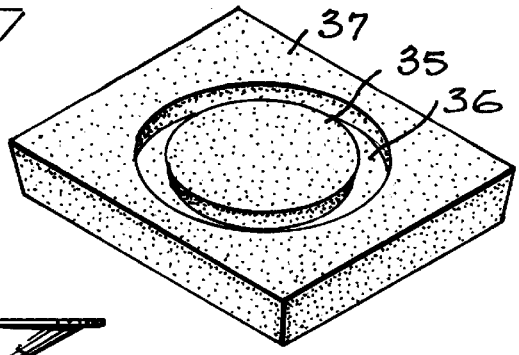
FIG. 4
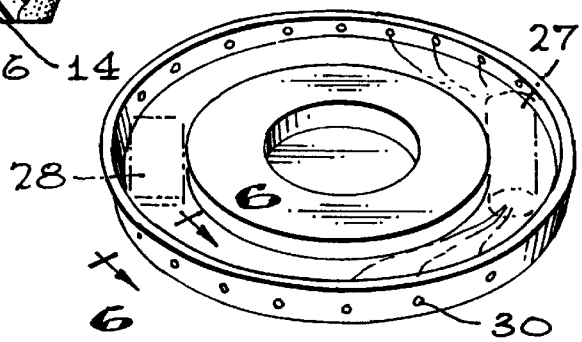
FIG. 6
FIG. 5
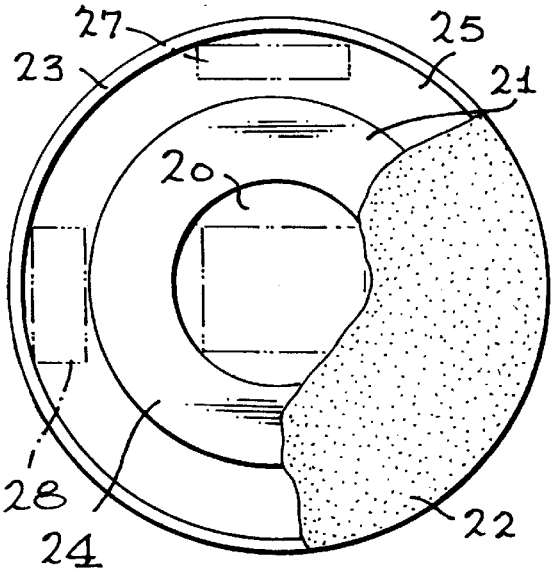
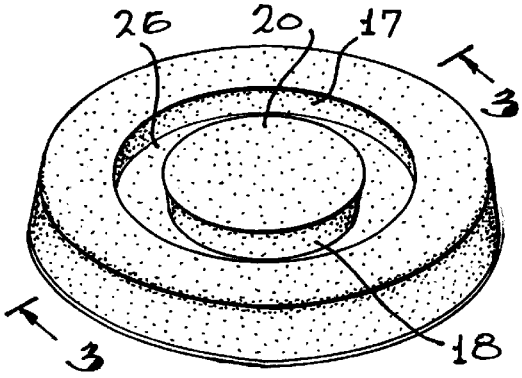
FIG. 2
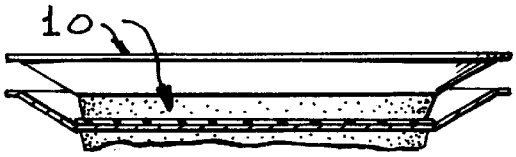
FIG. 8
FIG. 3
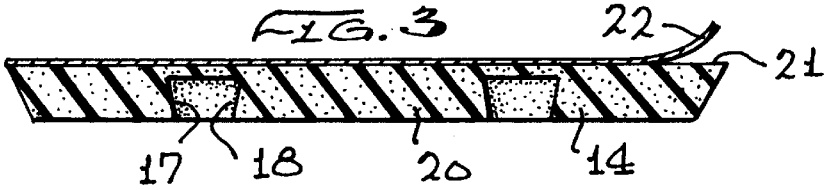

FIG. 9
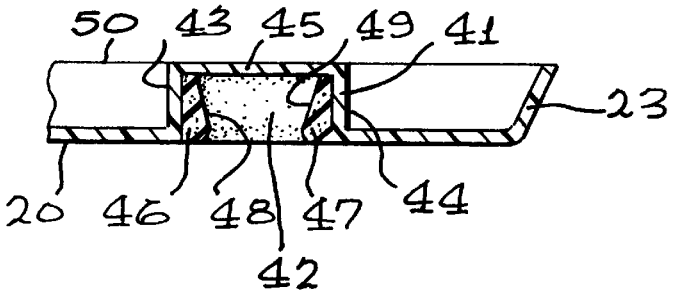
FIG. 10
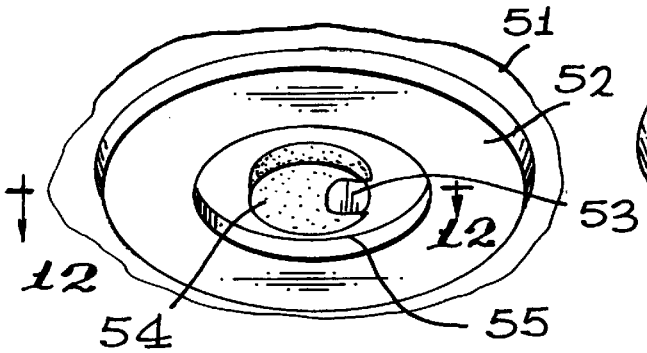
FIG. 11
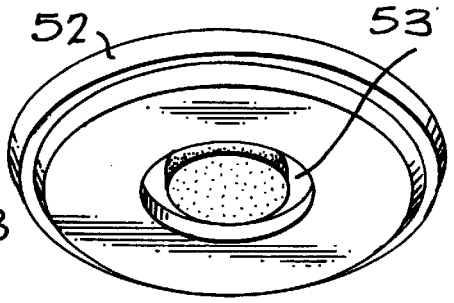
FIG. 13
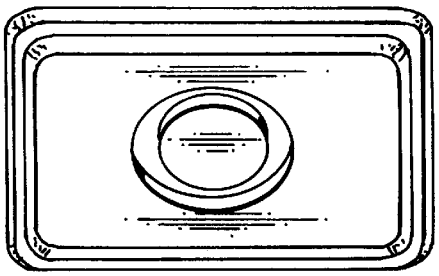
FIG. 14
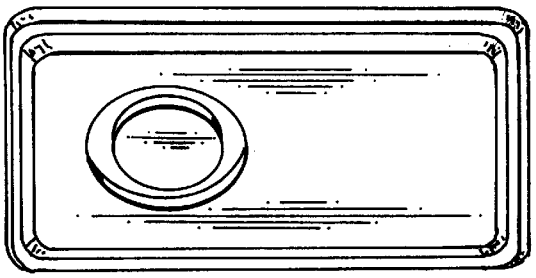
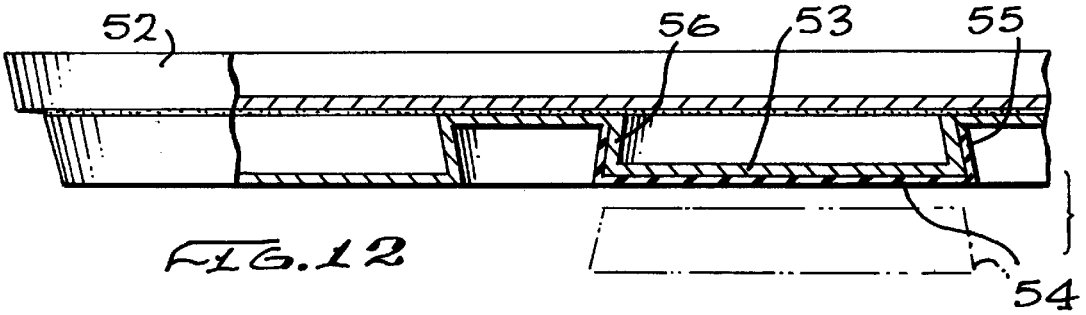
FIG. 12

SERVING TRAY

This application claims the benefit of U.S. Provisional Application Ser. No. 60/064,123, filed Nov. 3, 1997.

BACKGROUND OF THE INVENTION

1. Field of the Invention

The present invention relates to the field of serving trays for transporting food products, and more particularly to a novel hand-held tray supporting food products and which includes means for manually controlling the position and balance of the tray.

2. Brief Description of the Prior Art

In the past, it has been the conventional practice to employ a serving tray for food products such as cocktails, soft drinks, sandwich plates and the like. Such trays usually comprise a disk-like support with an upturned edge marginal region forming a continuous sidewall or edge wall. The supporting disk is flat on the top surface and the undersurface and when food products are carried, they are positioned on the top surface while the server or transporter's hand is engaged with the flat undersurface. Generally, in order to properly control and balance a food-carrying tray, the server's hand must be-radically bent at the wrist at an approximate 90 degree angle while the tray is being carried as the server walks. Such an angle is unnatural and can cause harm and injury to the server's hand, wrist and arm body components, such as muscles, ligaments or the like. Furthermore, it is difficult for the server to balance and therefore control the tray since liquid in the containers being supported by the tray often displaces so as to cause an unbalanced condition. Obviously, spillage or dropping of the tray may cause damage to customers as well as the server.

Therefore, a long-standing need has existed to provide a means for controlling the support and balance of a food and beverage carrying tray as well as alleviating physical discomfort in the user's wrist and hand. Such a means should be integral with the serving tray and not interfere with the support of food and beverage containers on the supporting surface of the tray. Also, means may be included which are decorative and which may be used for display or advertising purposes.

SUMMARY OF THE INVENTION

Accordingly, the above problems and difficulties are avoided by the present invention which provides a novel serving tray having a central supporting area with a flat top surface and an undersurface provided with a finger-gripping means. The finger-gripping means includes a member carried on the underside of the supporting surface which includes a ring-like groove defining a central core so that the user's fingers may be inserted into the groove and the exterior surface of the core grasped by the user's fingers.

Preferably, the means includes a table or bar engaging surface so that the tray, including the finger-gripping means, may be rested on a flat surface preparatory for receiving the beverage and food containers intended to be carried thereon.

Therefore, it is among the primary objects of the present invention to provide a novel serving tray having a gripping means on the underside thereof whereby the server's hand may be positioned directly under the tray and may be fully extended so as to avoid abnormal angular displacement of the hand and wrist.

Another object of the present invention is to provide a novel gripping means for the undersurface of a serving tray which not only permits the tray to be rested on a flat surface preparatory for supporting beverage items or food items.

Still a further object of the present invention is to provide a novel serving tray having a thickened element or component secured to the underside of a tray and which includes a groove or ring member adapted to receive the fingers of the user and to define a central core about which the user's fingers can grasp.

Yet another object resides in providing a cavity in the gripping component of a serving tray in order to accommodate illumination means as well as a power source and electronic controls as well.

A further object of the present invention resides in providing a ring-like element that may readily be attached to the underside of a conventional tray whereby the user's fingers may be inserted into the center of the ring or ring element providing a grasping relationship between the fingers of the user and the serving tray.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a front elevational view, partly in section, of the novel serving tray incorporating the present invention;

FIG. 2 is a perspective view of the finger-grasping means used with the tray shown in FIG. 1;

FIG. 3 is a transverse cross-sectional view of the finger-grasping means shown in FIG. 2 as taken in the direction of arrows 3—3;

FIG. 4 is an underview of the finger-grasping means such as shown in FIG. 2, illustrating a cavity for holding electronic components as well as illumination means;

FIG. 5 is a plan view of the finger-grasping means shown in FIG. 3;

FIG. 6 is a fragmentary sectional view of the embodiment shown in FIG. 4 as taken in the direction of arrows 6—6;

FIG. 7 is a perspective view of another version of serving tray finger-grasping means which is of a different geometry;

FIG. 8 is a transverse cross-sectional view of another version or embodiment of finger-grasping means;

FIG. 9 is a fragmentary sectional view of another embodiment of the finger-grasping means;

FIGS. 10 and 11 are top and bottom perspective views of another version of the invention;

FIG. 12 is an enlarged cross-section of the embodiment shown in FIGS. 10 and 11; and FIGS. 13 and 14 are perspective views shown symmetrical and asymmetrical placement of the core or projection.

DESCRIPTION OF THE PREFERRED EMBODIMENT

Referring to FIG. 1, the novel serving tray of the present invention is illustrated in the general direction of arrow 10 which includes a tray portion having a supporting member 11 on which a cushioned material, such as cork or the like is disposed and is represented by numeral 12. It is intended that food and beverage containers are to be placed on the support member 11 via the cushion 12 in order to be transported from a food preparation area to a customer. The edge marginal region of the support member 11 includes a rim or edge member 13 which is continuous and is open so that the food and beverage containers can be placed on the supporting member 11. It is to be particularly noted that the underside of the support member 11 includes a finger-grasping element or member 14 which includes a flat surface 15 so that the tray may be placed on the flat surface of a table, bar top or the like. The opposite surface of the finger-grasping member 14 is suitably secured or attached to the undersurface of the support member 11 by any suitable means such as adhesive or the like. It is also to be understood that the element or member 14 may be integrally formed with the support member 11 so as to provide a unitary construction.

It is to be particularly noted that the finger-grasping element or member 14 includes a circular groove, identified by numeral 16, which is defined between opposing angular surfaces of the groove which are broadly identified by numerals 17 and 18 as more clearly shown in FIG. 2. It is also to be noted that the surface 18 is continuous and defines a central core 20 that readily may be grasped by the fingers of the user, as shown in broken lines in FIG. 1. To increase the server's control, the surface 18 is divergent from the bottom of the groove out to the flat outer surface 15. Therefore, the fingers of the user may reach further or extend further into a better grasping relationship with the central core 20.

Preferably, the finger-grasping element or member 14 is composed of a material which is semi-rigid so that the fingers of the user may slightly compress or depress the material of the core as the user's fingers are pressed there-against. By inclusion of the angular surface 18 and the compressible material of the core 20, the server may readily tilt or balance the tray under complete control.

Referring now to FIGS. 3 and 5, it can be seen that the surface 21 may be covered with a peelable element 22 which, when removed, will expose an adhesive so that the element 14 may be readily secured to the underside of support element 11 of the tray. In this manner, the finger-grasping element 14 may be attached to any conventional or pre-existing tray.

Referring now in detail to FIGS. 4 and 5, it can be seen that the finger-grasping element or member 14 may include a circular rim 23 which is in fixed spaced-apart relationship with respect to a ring-like member 24 so as to provide an internal channel 25. The ring-like member.24, as viewed from the underside of member 14 in FIG. 2, defines a circular channel, as indicated by numeral 26. The channel 25 may be used to house electronic components such as a power source 27 and electrical components 28. These components may be operably connected to a plurality of lights, such as light 30, so that a suitable attractive display is provided. The display may be used for advertising purposes or for an attention or attraction means. As described with respect to the embodiment shown in FIG. 3, when the peelable covering 22 has been removed, an adhesive 21 is exposed so that the member 14 may be attached to the underside of the support member of the tray.

FIG. 6 illustrates the mounting and positioning of a typical light 30 in the sidewall or rim 23 of the member 14.

Referring now in detail to FIG. 7, another geometric configuration of the tray is illustrated taking the form of a rectangle or a square. The illustration suggests that the invention relates to other geometrical configurations than that of a circle or round configuration. The finger-grasping means is illustrated as core 35 surrounded by a groove 36, as previously described. The geometric shape of the element or member is indicated by numeral 37.

Referring now in detail to FIG. 8, it can be seen that a plurality of trays may be nested together for stacking purposes.

Referring now to FIG. 9, another embodiment of the invention is illustrated wherein the finger-grasping means includes a member 40 similar to the member 14 and which is formed with a channel section 41 that defines a channel 42 by sidewalls 43 and 44 with an interconnecting element 45. Within the open channel 42, a pair of rings, such as ring 46 and ring 47, are placed and adhesively secured to the respective sidewalls 43 and 44 of the channel element. It is to be particularly noted that the rings 46 and 47 include angular surfaces such as surface 48 associated with ring 46 and angular surface 49 associated with ring 47. In combination, the angular surfaces 48 and 49 provide converging surfaces towards the opening into the channel 42. This permits the user's fingers to be inserted into the channel 42 so that the user may grasp the angular surface 48. It is to be particularly noted that the purpose for angling the surface 49 in the embodiment 40 as well as angling the surface 17 in the embodiment shown in FIG. 2 is to permit the insertion of the user's fingers, including fingernails, into the channel. If the surface were to be perpendicular, then the possibility of the user's fingernails coming into contact with the ring or the edge of the channel would be injurious and unwieldy. Therefore, by increasing the area of the channel adjacent to the cross member 45 and decreasing the entrance leading into the channel, the fingernails of the user can be readily accommodated when inserted into the channel so that the flesh portion of the finger may grasp against the cushion material of ring 48.

Therefore, it can be seen that the user of the inventive tray may readily control and balance food products carried on the tray by inserting the user's fingers into the opening or channel surrounding the core 20 and by grasping the surfaces of the core from opposite sides. As shown in FIG. 1, the thumb and index finger of one hand grasp one side of the core while the little finger and remaining fingers of the hand grasp the opposite side.

A double back adhesive strip may be carried on the surface as noted by numeral 50 so that adhesion of the member 40 may be achieved with the underside 11 of tray 13. The core 20 is the same as shown in FIG. 2 as well as circular rim 23.

Referring to FIGS. 10 and 11, another embodiment of the invention is illustrated wherein a base 51 is provided with an internal recess 52 on its underside and which is further provided with a raised island or projection 53 in the center of the recess. The island is covered by a cap 54 which is composed of a resilient material similar to that described with respect to the material of element 14. The cap 54 is force-fitted over the top of the island or projection 53 so as to completely cover the projection. The cap 54 includes inwardly sloping peripheral edge 55 so that the user's fingers can readily grasp and hold the base when attached to a tray in a stabilized and fixed condition.

In FIG. 11, the opposite side of the base 52 is illustrated wherein the projection 53 is formed and appears to be hollow. The peripheral edge of the underside of base 52 and even the exposed undersurface of the projection 53 may be coated with an adhesive material for attachment to the underside of a serving tray as previously described.

Referring now in detail to FIG. 12, it can be seen that the cap 54 is in position for placement over the projection 53 as illustrated in broken lines. In solid lines, in section, the cap 54 has been installed on the projection 53 and it can be seen that the peripheral side of the projection 53 as well as the sides of the cap 54 are sloped and mated together. The sloping exterior side of the cap is indicated by numeral 55 while the sloping wall of the projection 53 is indicated by numeral 56.

Referring to FIGS. 13 and 14, it can be seen that the placement of the cap or finger-engaging portion can be symmetrical with respect to the tray or can be asymmetrical. Also, the finger-grasping portion may be integral with the serving tray and the present invention contemplates such a construction and is not limited to an accessory which is put onto a tray after its manufacture.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A serving tray comprising:

a base having a central supporting area with a flat top surface and an undersurface;

finger-gripping means carried on said undersurface;

said finger-gripping means downwardly depending from said undersurface and including a circular projection having a circular inwardly tapering outer peripheral surface and further having a circular outer wall coaxially disposed with respect to said projection provided with an inner circular surface outwardly tapered from said undersurface in fixed, spaced-apart relationship with respect to said inwardly tapering outer surface so as to define a circular groove therebetween; and said inner and said outer surfaces being in a non-parallel relationship.

2. The tray defined in claim 1 wherein:

said projection and said outer wall are adhesively engageable with and secured to said undersurface.

3. The tray defined in claim wherein:

said outer wall is a circular ring having a central opening occupied by said circular projection so as to define said circular groove in said coaxial relationship.

* * * * *